United States Patent [19]

Thies

[11] 4,006,612

[45] Feb. 8, 1977

[54] APPARATUS FOR THE WET PROCESSING OF TEXTILE STRANDS

[76] Inventor: Alfred Thies, Gerlever Weg 56, 442 Coesfeld, Germany

[22] Filed: Dec. 16, 1975

[21] Appl. No.: 641,262

[30] Foreign Application Priority Data

Dec. 16, 1974 Germany ..... 2459363

[52] U.S. Cl. ..... 68/177; 68/9; 68/152; 68/184

[51] Int. Cl.[2] ..... D06B 3/24; D06B 3/28; D06B 23/18

[58] Field of Search ..... 68/9, 27, 58, 62, 147, 68/148, 152, 158, 177, 184, 205 R

[56] References Cited

UNITED STATES PATENTS

| | | | |
|---|---|---|---|
| 1,107,160 | 8/1914 | Macadam | 68/158 |
| 1,704,066 | 3/1929 | Twaddle | 68/177 X |
| 2,555,065 | 5/1951 | Thomson et al. | 68/152 X |
| 2,680,084 | 6/1954 | Ryan | 68/205 R X |
| 2,764,009 | 9/1956 | Sarti | 68/27 X |
| 3,145,554 | 8/1964 | Grimes | 68/27 X |

*Primary Examiner*—Philip R. Coe
*Attorney, Agent, or Firm*—Roylance, Abrams, Berdo & Kaul

[57] ABSTRACT

An apparatus for the wet processing of textile strands including a kier with several drums therein, each drum being supported by rollers in the bottom of the kier for rotation about the central axis of the coaxial drums. The drums have central openings to permit the strand to be fed into and out of the drums in sequence. Jetting-in devices are associated with each drum to inject the strand under fluid pressure and reels are provided to guide the strand from the drums and to the respective jetting-in devices. A liquid circulating system withdraws processing liquor from the bottom of the kier and injects the liquid under pressure to the jetting-in devices. The drum walls are perforated. In one embodiment, the strand is recirculated through a series of drums in sequence and through a pipe extending through the central openings in the drum from the last to the first of the series. In a further embodiment the strand is passed through the sequence only once and the kier is provided with feed and discharge conduits with additional reels, jetting means and fluid recirculating means for guiding the strand. Walls at the ends of the kier adjacent the feed and discharge pipe connections establish pressure traps which are fluid filled to permit a pressure differential to be established between the interior and exterior of the kier. Systems employing multiple kiers of the type disclosed are also shown with interconnecting conduit arrangements to minimize the total height of the feed and discharge pipes and to maintain proper pressure differentials.

12 Claims, 9 Drawing Figures

Po
P1
P2
P'
M
H'
H''
H0
H2
101
102
Po + H0 = P1 = P' + H'
Po + H2 = P2 = P' + H''

Po
P1
P2
M
H0
H2-H0
31a
31b
101
102
110

Po
P1
P2
P3
M
H0
H1
H2
H3
31a
31b
101
102
103
111

APPARATUS FOR THE WET PROCESSING OF TEXTILE STRANDS

This invention relates to an apparatus for the wet processing of strand-like flat-shaped textile articles, the processing being, for example, dyeing, bleaching, washing, finishing and the like.

An apparatus of this general type has been proposed in a German patent application 24 48 385. which represents an addition to patent application 24 27 415. the former not being published. In the application of addition, two drums are disposed side-by-side in a kier with a distance between them in which two jetting arrangements designed as ring nozzle devices are disposed in parallel to one another. These jetting arrangements serve for the purpose of inserting an endless or continuous textile strand first into the inside of one drum where it is deposited on the inner annular surface thereof in an accordion fashion. As a result of this deposition of the textile strand, the drum is put into rotation so that the strand finally appears again at the opposite side of the drum and is drawn off from there by the second jetting arrangement and inserted into the second drum where the textile strand is again deposited in accordion fashion. As a result of this deposition, the second drum is also caused to rotate and the textile strand appears again at the opposite side of the second drum and is passed through the first mentioned jetting arrangement and is again fed into the first drum. The two drums are mounted in an overhung fashion by means of a shaft in the kier. Each drum was provided with a front plate or wall for its attachment to the shaft. The sides of the drums opposite the front wall are open leaving only a small inwardly projecting annular portion.

This apparatus, not previously known, has the advantage over customary devices that a textile strand of double the usual length can be processed in it. Frequently, however, there is a need, assuming that the drum dimensions are the same, for being able to process considerably longer textile strands so that, ultimately, a substantial length of a uniformly processed textile strand material can be achieved. This, however, was not possible, even in the apparatus of the above-mentioned application of addition. Another disadvantage of this apparatus consists in the fact that it is not able to process a textile strand which is to be passed only once through the apparatus, particularly when the processing of the strand requires a very long processing path.

The present invention is designed to improve that apparatus so that the above disadvantages are overcome and to result in equipment which makes possible a much greater spectrum of use.

In accordance with the present invention the drums are mounted without axles and are rotatably mounted by the outside portions of the drums in a kier by the interposition of glider or roller and guide mechanisms, the drums further having the advantage that the end walls of the drum have large central openings for the purpose of being able to rotate the drums without conflict with the jetting arrangements and the textile strand as it moves from one drum to another. With this arrangement, it is possible to arrange any number of drums side-by-side (the previous apparatus being limited to two drums) through which the textile strand is to pass in succession, without there being any chance of complicated deflections, obstructions to the movement or jamming of the textile strand.

Furthermore, in the apparatus of the present invention provision can be made for a reel to precede every jetting arrangement for the purpose of accommodating and guiding the textile strand. The purpose of the reels is to control the speed of movement of the strand to prevent variations in the jetting-in speeds from leading to an excessively rapid delivery of the strand into a drum or to slow a removal of the strand from the drum, either of which circumstances would lead to an accumulation of the textile material in the drum. The jetting arrangements are commonly constructed as venturi nozzle or ring nozzle units.

In this connection it is advantageous to couple all of the reels to each other to obtain equal peripheral speed of the reels whereby provision can be made so that the intercoupled reels are connected to a driving motor. This coupling permits a coupling of the rotational speed of the reel with the speed of revolution of the motor as a result of which the conveying speed of the textile strand is coupled indirectly through the entire apparatus with the motor speed, since the jetting-in of the textile strand by the jetting-in arrangements from one drum to another are controlled, either accelerated or delayed, by the rotational speed of the reel which can clearly be controlled.

The invention also contemplates constructing the peripheral walls of the drums in perforated fashion so that the processing liquor, having reached the inside of the drum during the jetting-in of the textile strand, can flow off directly from the inside of the drum into the inside of the kier surrounding the drum. Thus, the textile strand, which is deposited in the drum in an accordion fashion, will be stored therein and dried to a degree, as a result of which the uniformity of the processing of the textile strand is further improved. Ribs can also be provided on the inside annular surfaces of the drums for improved drive of the drums under the influence of the weight of the textile strands which are deposited on the interior walls about the lower portion of the drum walls.

The invention further contemplates providing in the lower half of the kier roller elements which cooperate with flanges on the drum to permit rotation and limit axial movement of the drums.

For a situation in which a textile strand is to be continuously recirculated through a sequence of drums in a series arrangement, the invention contemplates providing an additional reel after the last drum and an additional jetting arrangement associated with the reel so that the strand can be taken from the last drum, passed around the reel and jetted into a guide tube which delivers the strand to the area of input to the first drum. With this apparatus, the textile strand is fed from the last downstream drum to the first drum without any need for particularly expensive or complicated arrangements for this purpose. It will be noted that the pipe is guided through the centers of these drums, a feature which is possible because of the unique mounting arrangement thereof.

In the case of an apparatus designed for single passage of a strand through a kier, the kier is provided with an inlet or feed pipe at one end thereof and a discharge pipe for the textile strand at the other end. A reel at the outlet or downstream end of the kier is connected after the last drum to guide the strand to the outlet or discharge pipe. The provision of these pipes also makes a pressure operation of the apparatus possible.

The inlet and outlet pipes connected to the kier can be disposed vertically with the connection points thereof near the bottom of the kier. Separating walls across the lower portion of the kier, and extending above the locations of the inlet and outlet pipe connections, define chambers which form pressure gates, when filled with liquid, to provide a pressure-tight closure between the inside of the kier and the surrounding environment. From basic hydraulic theory, it will be recognized that the liquid in these pressure gates must be such that there is a difference in level between the liquid on the inside of the kier and the level of the liquid of the pipes outside of the kier and also from the level in the interior portion of the kier apart from the chambers. This difference will correspond to the difference between the inside and outside pressures, with due consideration of the liquid used. For a relatively short vertical length of construction of the pipes with simultaneously relatively high pressure differences between the inside of the kier and the surroundings, the apparatus can be provided with a circulating pump connected with its suction side to the pressure-gate chambers and with its pressure side to jetting-in arrangement which are attached near the lower portion of the feed and discharge pipes, which arrangements empty into the inside of the pipes by the way of flow directors aligned in the direction toward the inside of the kier. In this way, a dynamic counter pressure can be developed at the mouths of the pipes at their point of connection with the kier, resulting in the fact that the static pressure which is required for sealing the inside of the kier and which is a function of the level of filling of the pipe can be reduced so that there is a distinct saving in the length of the pipe required.

Because in devices intended to perform the functions of processing performed by the present invention are frequently accomplished at high temperatures, the cooling of the pressure sealing fluid is frequently desirable or necessary in order to prevent evaporation of the liquid used. Thus, the invention further contemplates incorporation of a heat exchanger in the area of the circulating pump for the pressure sealing liquid.

In order that the manner in which the foregoing and other objects are attained in accordance with the invention can be understood in detail, particularly advantageous embodiments thereof will be described with reference to the accompanying drawings, which form a part of this specification, and wherein.

Figure 2:
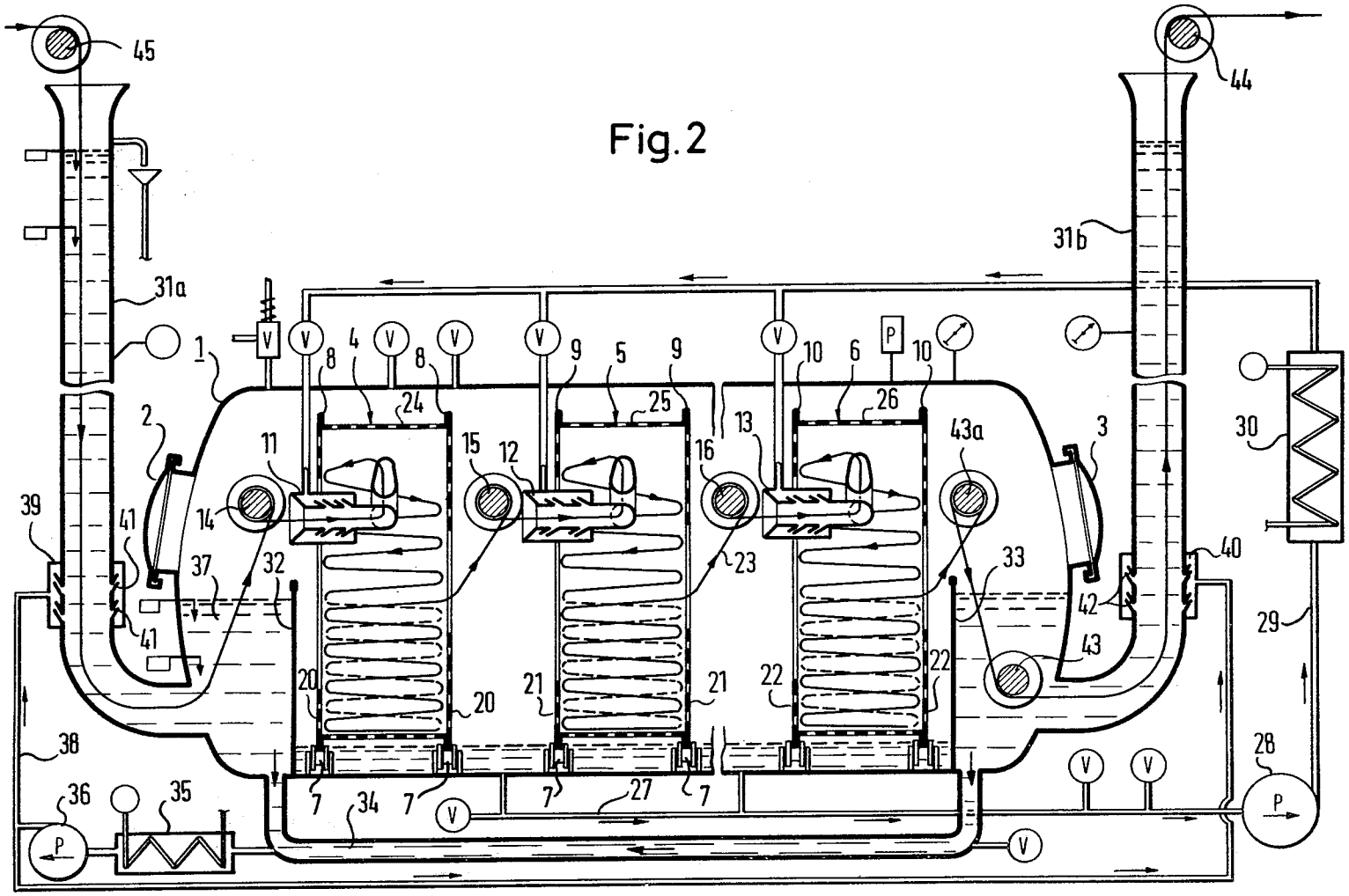
FIG. 2 is a schematic side elevation in longitudinal section through a second embodiment of the invention.
Figure 4A:
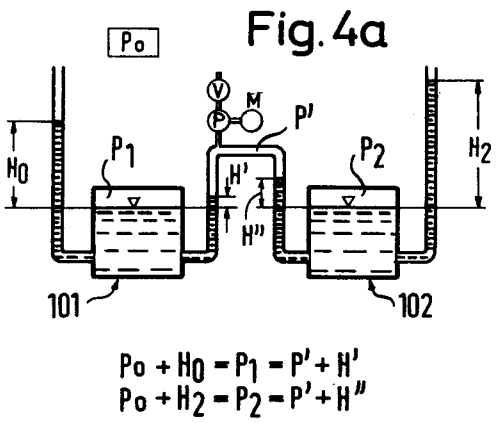
FIG. 4 is a schematic diagram of an installation with two series connected units of the embodiment of FIG. 2.
Figure 4:
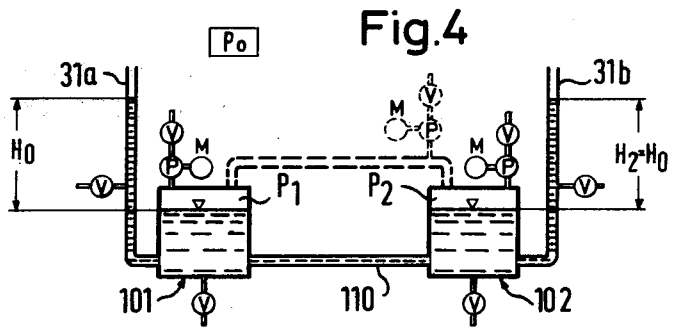
Figure 5:
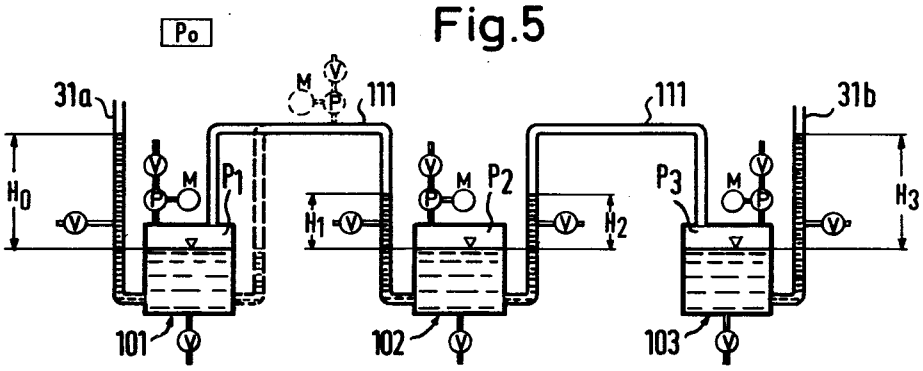
Figure 6:
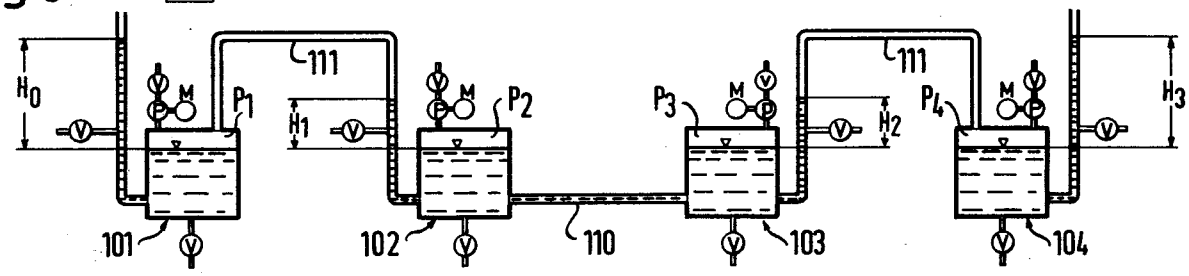
Figure 7:
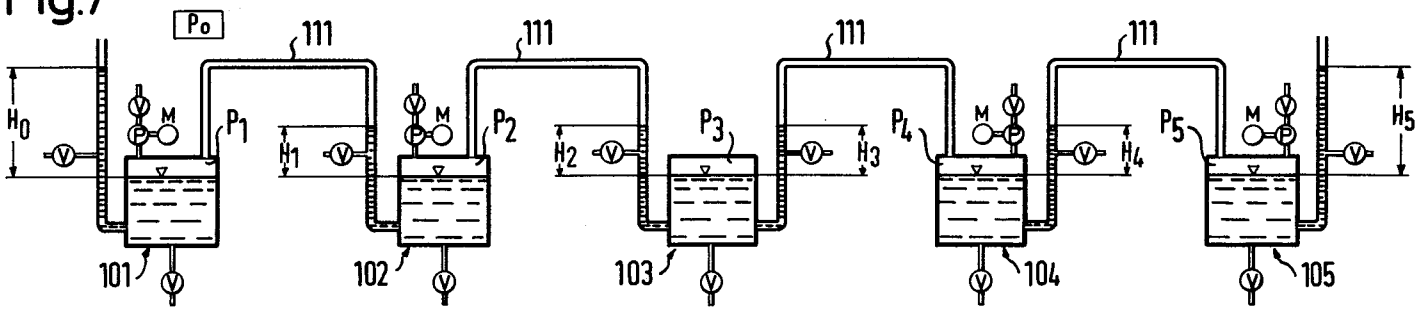
Figure 8:
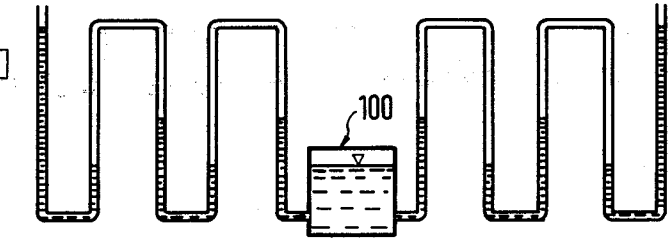

FIG. 4*a* is a schematic diagram of a modified installation according to FIG. 4;

FIG. 5 is a schematic diagram of an installation with three series connected units of the embodiment of FIG. 2;

FIG. 6 is a schematic diagram of an installation with four series connected units of the embodiment of FIG. 2;

FIG. 7 is a schematic diagram of an installation with five series connected units of the embodiment of FIG. 2; and FIG. 8 is a schematic diagram of a special installation with a single unit of the embodiment of FIG. 2.

Figure 1:
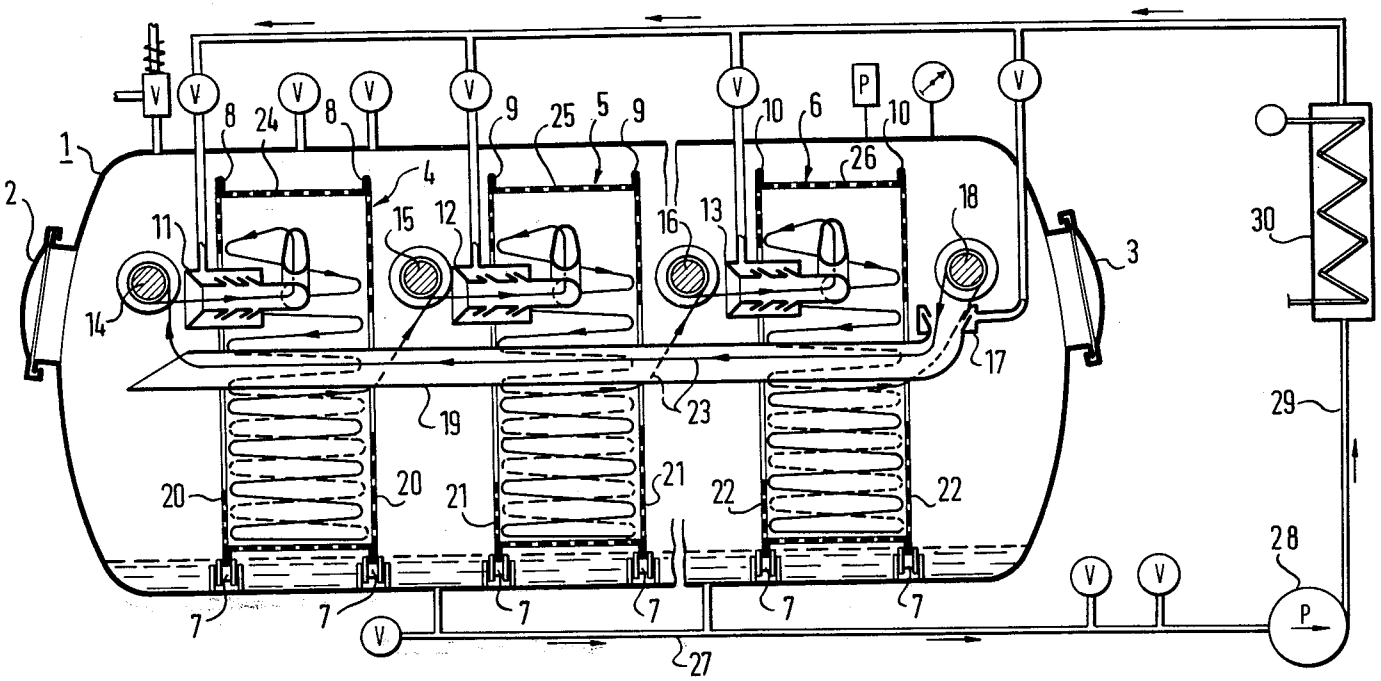
FIG. 1 is a schematic side elevation in longitudinal section through a first embodiment of the invention.
Figure 3:
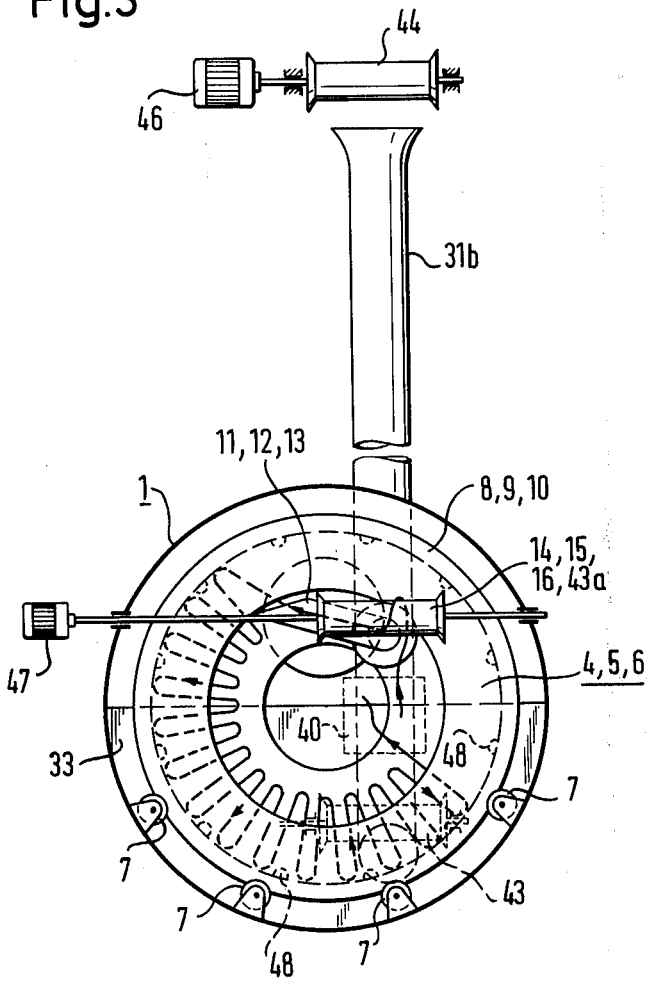
FIG. 3 is a schematic and elevation in section through the embodiment of FIG. 2, along lines III—III.

FIG. 1 shows a pressure-tight kier 1 with two lids 2 and 3 for closing access openings in the kier. Three drums indicated generally at 4, 5 and 6 are rotatably mounted in side-by-side coaxial relationship within the kier. Each of drums 4, 5 and 6 is provided with two annular radially outwardly extending flanges, the flanges on drum 4 being indicated at 8, those on drum 5 at 9, and those on drum 6 at 10. These flanges or rotational edges act as supporting members for the drums. A plurality of rotatably mounted rolls 7 are supported in the lower portion of the inside of kier 1, each of the rollers having a central portion which receives one of edges 8–10 and axially spaced flanges which overlap the drum rotational edges and limit the axial movability of the drums. As seen in FIG. 3, rollers 7 are circularly spaced within the interior of the kier.

Each of drums 4, 5 and 6 is provided with end walls having central openings, and with each drum is associated a ring nozzle "jetting-in" unit, units 11, 12 and 13 preceding and being associated with drums 4, 5 and 6, respectively. Reels 14, 15 and 16 are mounted adjacent to and operatively associated with, each of jetting-in units 11, 12 and 13, respectively.

Downstream from the last drum 6 there is an additional ring nozzle jetting-in arrangement 17 which is series connected to drum 6 and which is preceded by a further reel 18. A guide pipe 19, which extends through the central openings of all three drums, follows the jetting-in nozzle 17, the other end of pipe 19 terminating near reel 14.

End walls 20, 21 and 22 of drums 4, 5 and 6, respectively, have central openings, as previously indicated, the extent of the openings being sufficient to permit free rotation of the drum so that this rotation is not impeded in any fashion by the jetting-in arrangements 11, 12 and 13 which project through the openings into the interiors of the drums, and also to prevent any interference with pipe 19. Additionally, the openings are sufficiently large so that there is no interference with textile strand 23 as it emerges from one drum to the next following reel. Walls 20, 21 and 22, together with annular walls 24, 25 and 26 of the drums are perforated.

A suction pipe 27 is connected at at least two points to the bottom of kier 1, pipe 27 being connected to a circulating pump 28 for the processing liquor. A pressure line 29 connected to the output of pump 28 is connected to a heat exchanger 30, the output conduit of which is connected to the jetting-in arrangements 11, 12, 13 and 17 to provide the motive fluid pressure. As generally indicated in FIG. 1, there are additionally a variety of valves and measuring devices which serve for the regulation and control of the operating conditions of the apparatus, e.g., for the reduction of the operating pressure, for the feeding in of special chemicals, and similar functions.

The manner in which the wet processing of a textile strand 23 takes place in the apparatus of FIG. 1 can be readily recognized from the figure itself and no detailed explanation appears to be necessary. The fluid under pressure provided by pump 28 feeds strands through the path including pipe 19, reel 14, through jetting-in nozzle 11 into the interior of drum 4 where it is disposed in the pattern generally indicated. The strand is withdrawn from drum 4, passed around reel 15 and jetted into drum 5 where it is similarly disposed. The strand then continues onto reel 16, nozzle 13 and drum 6, from which it is withdrawn, passed around reel 18 and jetted into pipe 19 by nozzle 17, after which the circuit is continued.

A further embodiment of an apparatus according to the invention is shown in FIG. 2 wherein the interior portions of the apparatus in the kier will be seen to be similar to those of FIG. 1 in structure and function and, which, therefore, have the same reference numerals and will not be further described. The major difference between the embodiments of FIGS. 1 and 2 is the absence in FIG. 2 of pipe 19 and the provision of input and output conduits. At the input end of kier 1 there is provided a feed pipe 31*a* and at the output end a discharge pipe 31*b*. A separating wall 32 is provided at the input end of the kier between the end wall thereof and drum 4 and a similar wall is provided near the output end between drum 6 and the end wall of the kier. These walls are essentially semi-circular in shape and form, with the end walls of the kiers and the feed and discharge pipes, fluid confining chambers. These chambers, after being filled with a closing liquid, represent a pressure gate so that the inside of the kier is sealed, from a pressure point of view, from the surrounding environment. It will also be observed that the higher pressure prevailing in the interior of the kier with respect to the surrounding environment causes a substantial difference between the levels of the liquid surfaces on the inside of the kier and in the respective pipes, as illustrated in FIG. 2. Thus, in the event of a high excess pressure on the inside of the kier as compared to the surrounding pressure, the vertical construction height of pipes 31*a* and 31*b* must not be too high. According to the illustration, each of the chambers is connected by way of a suction line 34 and a heat exchanger 35 with a circulating pump 36 for the closing liquid 37, whereby the pressure line 38 of the circulating pump is always connected with a jetting-in arrangement 39 in pipe 31 and an arrangement 40 in pipe 31*b*. These jetting-in arrangements 39 and 40 are developed as ring nozzle-jetting arrangements into which flow guides 41 and 42, respectively, have been inserted in such a way that the closing liquid jetted into the inside of the pipe is forced into pipe 31*a* or 31*b* in a direction toward the chambers thus discribed. The jetting-in arrangements 39 and 40 therefore constitute an additional dynamic pressure gate in connection with flow guides 41 and 42, as a result of which the vertical construction height of pipes 31*a* and 31*b* can be reduced.

In the area of the chamber formed by wall 33 there is provided an additional reel 43 which constitutes a deflection roll by means of which the textile strand can be guided from reel 43*a* into pipe 31*b*. An additional reel 44, also acting as a deflection roll, is disposed adjacent the open end of pipe 31*b*. A corresponding deflection roll 45 is disposed adjacent the open end of feed pipe 31*a*. As shown in FIG. 3, reel 44 is driven by a motor 46 and reels 14, 15 and 16 are connected with and driven by a driving motor 47 which establishes uniform drive of reels 14, 15 and 16. The driving motor 47 could also be a transmission or coupling arrangement of a type which will permit driving reels 14, 15 and 16 at the same speed.

Also as shown in FIG. 2, various pressure monitoring valves and overflow arrangements are provided at pipes 31*a* and 31*b* and in the chambers for the sealing liquid, which devices serve for the regulation of the adjustability of the counter pressure working against the inside pressure of the kier.

As shown in FIG. 3, a plurality of ribs 48 are disposed on the interior surface of annular walls 24, 25 and 26 of drums 4, 5 and 6, respectively, which ribs are engaged by the textile strands inserted into them and drums 4, 5 and 6 are thereby rotatably driven through the influence of the textile strands.

It should be noted that devices as shown in FIG. 2 can be employed in conjunction with each other, connecting several such devices in series forming a multiple device embodiment according to the invention. Whenever more than two such devices according to FIG. 2 are connected in series, for example, three such devices, then the possibility exists of building up a considerably higher pressure in the inside of the middle one of the devices, e.g., the second device, by the addition of the pressures of the first and second stages.

Furthermore, in the embodiments of both FIG. 1 and FIG. 2, the possibility exists of providing a separate pump with a non-return valve for the introduction of chemicals, other liquids or water for each one of the drums. In this connection, it will then furthermore be effective to compartmentalize the individual areas of the kier, in which case each drum can be accommodated in one such chamber. In that case, it is then possible to establish variable processing from drum to drum. Because, as a result of the introduction of chemicals, high water levels can develop, the capability for drawing off these high water levels should also be provided or a circulating guidance system for the pertinent liquor should be provided for the areas of each individual drum. In this circulation system, a cooler and pressure control valve can be connected in as needed in accordance with the pertinent requirements, so that a continuous circulation control of the liquor starting out from the output drum of the kier and back again into it and again back into the drum can be accomplished.

Finally, the locking or sealing liquid provided in pipe 31*b* of the embodiment of FIG. 2 can also be used as a processing liquid as, for example, by allowing it to flow over into the inside of the kier as a rinsing water for the purposes of rinsing and washing. As a result of such an operation, the contamination of the fresh water by the locking liquid will be prevented, and, at the same time, a desired rinsing effect in the apparatus will be made possible after the accomplishment of certain treatments.

FIG. 4 schematically shows an installation for the continuous processing of textile material and consists of two series connected units of the type shown in FIG. 2. The feed pipe 31*a* has been provided only on the first unit 101, while the discharge pipe 31*b* has been provided only on the second unit 102. Units 101 and 102 are interconnected by a pipeline 110 through which pipeline the textile material can be conducted from unit 101 into unit 102 and an equalization of pressure takes place between the two units as well. The connecting pipe 110 can interconnect units 101 and 102 in an area which lies below the surface level of the processing liquor or, alternatively, the interconnection pipe can be provided above the level of the processing liquor as indicated in the dashed lines in FIG. 4.

FIG. 4*a* shows a modified form of an installation of the type shown in FIG. 4 wherein the interconnection between the units 101 and 102 constitutes a pipe in the shape of an inverted U in place of pipeline 110. With this arrangement it is possible to provide in the two units 101 and 102 different and variable pressures $P_1$ and $P_2$ with each unit being sealed or locked at both the input and output regions thereof by means of a column of liquid which has a height corresponding to the relative pressures. In this case, a pressure P' will be established in the central portion of the U-pipe. This arrangement, in connection with a subdivision of the heights of columns $H_0$ and $H_2$, as will be hereinafter described in connection with FIG. 8, permits very low construction heights of the installation.

FIG. 5 shows an installation with three series connected units 101, 102 and 103, each of which is of the type shown in FIG. 2, wherein the feed pipe 31*a* is provided on the first unit 101 and the discharge pipe 31*b* on the third unit 103. The entire installation as shown in FIG. 5, as in the case of FIGS. 4 and 4*a* and the installations of FIGS. 6–8 are developed symmetrically. Therefore, in each case, only one-half of each installation will be described in detail. In the case of FIG. 5, the first unit 101 is connected with the second middle unit 102 by way of a connecting pipe 111 which is constructed as a U-pipe, the leg of the U-pipe connected to unit 102 being filled with a processing liquor and, because a higher pressure is to prevail in unit 102 than in unit 101, the liquor rises to a level which lies about the liquor level in unit 102. The second leg of the pipe 111 which is connected with unit 101 is connected to unit 101 above the level of liquor. However, an alternative installation as shown in the broken lines in FIG. 5 permits connection of conduit 111 to unit 101 below the surface level of the liquor contained therein.

FIG. 6 shows an illustration with four series connected units 101, 102, 103 and 104 wherein the connection between units 101 and 102 or 103 and 104 corresponds to the connection of the units 101 and 102 or 102 and 103 according to FIG. 5 while the connection of units 102 and 103 corresponds to that of units 101 and 102 of FIG. 4. FIG. 7 shows an installation with five series connected units 101–105, wherein the connection between units 101 and 102 and between 102 and 103, or between 103 and 104 and between 104 and 105 corresponds to the connection of unit 101 with 102 or 102 with 103 as illustrated in FIG. 5.

FIG. 8 shows an installation with only a single unit 100. In this case, the U-pipes 111 according to FIG. 7 have been maintained between unit 100 and feed pipe 31*a* and have also been provided between the output of unit 100 and discharge pipe 31*b* and the U-pipes have been connected with each other, making it possible to provide within unit 100 a pressure which would be such as to normally require an extremely high liquor level in input and output pipes 31*a* and 31*b*. However, by providing the U-shaped pipes as illustrated, the overall height of the installation is greatly diminished because the liquid level necessary is subdivided into several liquid columns lying parallel side-by-side.

As can be recognized from the systems illustrated in FIGS. 4–8, it is possible in each one of the individual units of the various installation configurations to adjust substantially every desirable processing pressure without there being any need for particularly long feed or discharge pipes 31*a* or 31*b*. In particular, it is possible in the first and last unit and in the second and into the next to last units, etc., to always adjust equal pressures and at the same time to allow the pressures in the units between the first and last to rise in a direction toward the middle of the total installation. It is, indeed, possible to establish an arrangement such that in the middle unit, or in the several middle units where such exist, to provide a pressure which corresponds to the sum of the pressures of the end units. Thus, for example, in the third unit 103 of the installation according to FIG. 7, a pressure $P_3$ can be used, which pressure corresponds to the sum of pressures $P_1$ and $P_2$ existing in units 101 and 102, respectively.

In FIGS. 4–8, the individual units have been shown merely schematically, leaving out all of the inside components, but in each case the level of the processing liquor is illustrated. Furthermore, the level of the processing liquor in the U-pipes and in the feed and discharge pipes has been shown. In these drawings the symbols $H_0$, $H_1$, $H_2$ . . . always designate the height of the liquid column in the pipes as measured above the level of the processing liquid in the associated processing unit. $P_0$ designates the ambient pressure and $P_1$, $P_2$ . . . indicate the pressure within the pertinent processing unit 101, 102, etc.

Merely by way of example, the mathematical relationship of the physical principles is stated as follows for the installation of FIG. 5 with three series connected units 101, 102 and 103 whenever said installation is to be operated in a particularly preferred manner with the same pressure in the first and last unit and with an increased pressure in the direction of the middle unit.

For $P_1$ and $P_3$ it is generally valid:

1. $P_1 = P_0 + H_0$
2. $P_3 = P_0 + H_3$.

When it is to be valid that

3. $P_1 = P_3$, then from that it follows from equations 1 and 2 that

4. $H_0 = H_3$.

For $P_2$ generally it is valid that

5. $P_2 = P_1 + H_1$ and

6. $P_2 = P_3 + H_2$.

From equations 5 and 6 in connection with equation 3, it follows that

7. $H_1 = H_2$.

In the preceding equations $P_0$, $P_1$ . . . must be inserted in pressure units and $H_0$, $H_1$ . . . in, e.g., meters of water column after the proper recalculation into the same pressure units. All pressures $P_0$, $P_1$ . . . are absolute pressures, for example measured in ata or psia, so that for the determination of the processing pressures in the units which customarily are merely given as an excess pressure, the pressures $P_1$, $P_2$ . . . are reduced by the value $P_0$.

In the case of an installation like that shown in FIG. 5, the heights $H_1$ and $H_2$ are developed equally as large as the height $H_0$ or the height $H_3$, which is equally as high as the former, then there follows from 8. $H_0 = H_1 = H_2 = H_3$ in connection with equations 5 and 1
9. $P_2 = P_0 + 2H_0$, so that the operating pressure in the first unit 101, measured as an excess pressure vis-a-vis the pressure $P_0$ of the free surroundings, is $H_0$, while the operating pressure in the second and the middle unit 102 again measured as excess pressure as compared to the pressure $P_0$ of the free surroundings is $2H_0$, therefore double the operating pressure of the preceding first unit 101.

After adaptation to the pertinent constructional conditions and the operational technical data, the preceding mathematical relationships can be applied without difficulty to all other installations shown in the figures after corresponding modification.

While certain advantageous embodiments have been chosen to illustrate the invention, it will be understood by those skilled in the art that various changes and modifications can be made therein without departing from the scope of the invention as defined in the appended claims.

What is claimed is:

1. An apparatus for the wet processing of an elongated flat-shaped textile strand in a processing liquor comprising a kier capable of accommodating a long length of the textile strand;

at least two drums inside said kier, each of said drums having an annular wall and end walls;

jetting-in means associated with each of said drums for inserting said strand into its associated drum;

means in said kier radially displaced from the central axis of said drums for engaging and rotatably supporting said drums for rotation about said central axis;

means cooperating with said drums and said jetting-in means for establishing a predetermined path of travel in said kier from one drum to another in a series sequence; and circulating system means including a pump for recirculating said processing liquor under pressure to said jetting-in means and from the bottom of said kier;

the end walls of said drums having means defining central openings to permit insertion and withdrawal of said strand, said central openings being dimensioned to avoid conflict with said jetting-in means and said strand.

2. An apparatus according to claim 1 wherein said means for establishing a path of travel includes a plurality of guide reels, one reel associated with each of said jetting-in means, for guiding said strand.

3. An apparatus according to claim 2 and including means for coupling said reels together for rotation at a uniform equal speed.

4. An apparatus according to claim 3 and further comprising a driving motor connected to said means for coupling.

5. An apparatus according to claim 1 wherein said annular walls include means defining a plurality of perforations.

6. An apparatus according to claim 1 wherein said annular wall includes means defining a plurality of axially extending ribs on the interior surface of said wall.

7. An apparatus according to claim 1 wherein each of said drums includes first and second flanges extending radially outwardly beyond said annular wall;

and wherein said means for supporting includes a plurality of rollers mounted in said kier for engaging said flanges for rotatably supporting said drums.

8. An apparatus according to claim 1 and further comprising a feed pipe connected to one end of said kier;

a discharge pipe connected to the other end of said kier;

a first guide reel adjacent said discharge pipe to guide said strand into said pipe; and a second guide reel at the outlet end of said discharge pipe.

9. An apparatus according to claim 8 wherein said feed and discharge pipes are substantially vertical.

10. An apparatus according to claim 8 and further comprising first and second barrier wall means mounted in said kier to define first and second chambers at the ends of said kier with the end walls to which said feed and discharge pipes are connected, said chambers being arranged to be filled with liquid to form pressure gates to isolate the interior of said kier from the ambient and to permit a pressure differentiated to exist across said gates.

11. An apparatus according to claim 10 and further comprising a second circulating pump;

first conduit means connecting the inlet side of said second pump to said chambers;

first and second jetting-in means in said feed and discharge pipes, respectively;

second conduit means connecting the pressure side of said second pump to said first and second jetting means, said jetting-in means having flow directors to direct liquid into said pipes in the direction toward said chambers.

12. An apparatus according to claim 11 further comprising a heat exchanger in one of said first and second conduit means.

* * * * *